United States Patent [19]

Hirsch et al.

[11] 4,055,672

[45] Oct. 25, 1977

[54] CONTROLLED ATMOSPHERE PACKAGE

[75] Inventors: Arthur Hirsch, Elizabeth; Francis X. Spiegel, Cedar Grove, both of N.J.; John M. Ramsbottom, Glenn Ellyn, Ill.

[73] Assignee: Standard Packaging Corporation, New York, N.Y.

[21] Appl. No.: 672,455

[22] Filed: Mar. 31, 1976

Related U.S. Application Data

[63] Continuation of Ser. No. 242,430, April 10, 1972, abandoned.

[51] Int. Cl.[2] ..... B65D 81/20

[52] U.S. Cl. ..... 426/127; 206/439; 206/484; 206/525; 229/43; 426/123; 426/129; 426/396

[58] Field of Search ..... 426/112, 115, 123, 127, 426/129, 394, 396, 415; 206/498, 525, 484, 439; 229/43

[56] References Cited

U.S. PATENT DOCUMENTS

| | | | |
|---|---|---|---|
| 3,151,799 | 10/1964 | Engles Jr., et al. | 229/2.5 |
| 3,154,225 | 10/1964 | Wadlinger et al. | 426/116 X |
| 3,301,464 | 1/1967 | Amberg | 229/43 |
| 3,393,077 | 7/1968 | Moruea | 426/410 |
| 3,454,210 | 7/1969 | Spiegel et al. | 229/43 |
| 3,464,832 | 9/1969 | Mullinix | 426/393 |
| 3,552,638 | 1/1971 | Quackenbush | 206/484 X |
| 3,574,642 | 4/1971 | Weinke | 426/124 |
| 3,650,390 | 3/1972 | Hoon | 206/541 |
| 3,681,092 | 8/1972 | Titchenal et al. | 426/412 |
| 3,713,849 | 1/1973 | Grindrod | 206/541 |

*Primary Examiner*—Steven L. Weinstein

[57] ABSTRACT

A package is provided for controlling the atmospheric condition of a packaged product and includes first and second package walls sealed at their peripheries to define a product cavity therebetween. One package wall is formed from a gas impermeable material and the second package wall includes a composite of an inner gas permeable layer and an outer gas impermeable layer. The outer layer is adapted for removal from the inner layer without destroying the seal between the first and second package walls so as to allow gases to flow through the inner layer and to thereby change the atmospheric condition of the packaged product.

6 Claims, 5 Drawing Figures

CONTROLLED ATMOSPHERE PACKAGE

This is a continuation of application Ser. No. 242,430 filed Apr. 10, 1972, now abandoned.

This invention relates to packages capable of controlling the atmospheric condition of the product contained therein. More particularly, the invention is concerned with packages for perishable food products which are adapted to preserve the freshness of such product for relatively long periods of time.

Present methods for the packaging of perishable food products, such as fresh raw meat, involve transporting the meat in bulk from a central slaughter house to the retail outlet where it is cut into portions, placed on plastic or paper trays, over-wrapped with a transparent film and placed in a refrigerated display case for sale to the consumer. Those concerned with the development of meat packaging have long recognized the economic advantage of performing all of the meet-cutting and packaging at centrally located slaughter houses rather than in the individual retail outlets. However, the bright red color of meat normally associated with freshness and high quality by the consumer cannot be maintained for more than a few days. Thereafter, the interaction of oxygen with myoglobin present in the meat, which initially produces the bright red color, continues to the point where the meat is discolored and loses moisture. Since the shelf-life of fresh meat is already extremely small, the longer shelf-life requirements which would be necessitated by centralized meat processing, have made such centralized processing unfeasible.

Previous attempts to increase the shelf-life of prepackaged fresh meat have not been commercially acceptable. One such attempt involves packaging the meat in a vacuum or under an inert atmosphere. Although this type of packaging retards bacterial as well as mold growth, it also changes the meat color from its normal bright red to a commercially unacceptable purple color. A second attempt to increase shelf-life involves the distribution of frozen meat. However, consumers have exhibited a reluctance to purchase frozen meat since it also lacks the red meat color associated with freshness and high quality. Finally, attempts have been made to provide packaging which can selectively control the package atmosphere thereby increasing shelf-life and providing a product having a desirable appearance. However, such packages have been of crude thereby resulting in prohibitive material and labor costs which have prevented their commercial acceptance.

It is an object of this invention to provide a novel integral package which will increase the shelf-life of the products contained therein.

It is another object of the invention to provide an integral package for fresh red meat and other products which may be adversely affected by normal atmospheric conditions which will prevent exposure to the atmosphere but which is adapted to permit exposure to the atmosphere at an appropriately chosen time.

Yet another object of the invention is to provide a package for fresh meat which will permit the meat to remain fresh for an extended period of time and permit the meat to exhibit the red color associated with freshness at a selected time.

Still another object of the invention is to provide a novel and simple package construction capable of providing increased shelf-life for products which is economical, easy-to-handle and minimizes labor costs.

In accordance with the present invention, a novel package construction is provided in which the package walls are formed, at least in part, from a novel combination of gas permeable and gas impermeable films which are joined in such a fashion that the atmospheric content of the package can be controlled without destroying the integrity of the package. More particularly, the present invention contemplates a package construction in which all outer surfaces of the materials comprising the initial package walls are formed from a gas impermeable film which will prevent the exposure of the package contents to the ambient atmosphere, but in which a portion of the outer surface of the package is readily removable thereby exposing a gas permeable film section of the package. By proper selection of the films, techniques and materials used to form the unique composite package of the invention, the exposure of the gas permeable film layer of the package to the surrounding atmosphere does not result in the rupture of any of the packaging films or seals forming the basic package and an integral, sealed protective package will still surround the product after removal of the outer gas impermeable layer thereby continuing to provide full protection against contaimination.

The novel package construction of the invention permits rapidly perishable food products, such as fresh red meat which normally has a shelf life of about three days, to be pre-packaged and maintained in packaged form for long periods of time without adverse effect. For example, a meat product may be placed in a package constructed in accordance with the invention and package under conditions which exclude oxygen from the container. Typically, the packaging would occur under vacuum or in an inert atmosphere. Since the package construction of the invention comprises an outer gas impermeable layer which also excludes oxygen, and other gases from reaching the package interior, the chemical reaction which produces the fresh red meat color and which ultimately causes meat deterioration is prevented and the meat turns a deep purple in color. The product may be maintained in this condition for the extended period of time which may be required for distribution and storage prior to sale without adverse effect. At the point of sale, the unique package construction of the invention permits the ready removal of the outer gas barrier layer of the specially constructed composite package of the invention which can be performed almost instantaneously by unskilled labor thereby exposing the gas permeable portion of the package. The exposure of this portion triggers the chemical reaction in the meat product which is responsible for the frest meat color and the meat will "bloom" from purple to bright red in a matter of a few minutes.

The novel package of the invention may be constructed in a variety of fashions to achieve a package having the desired characteristics. In a preferred embodiment, the package comprises a semi-rigid, preformed tray constructed of a gas impermeable material which is provided with a lid capable of being heat sealed to the open face of the tray. The lid comprises a composite of an outer gas impermeable layer and an inner gas permeable layer. In one embodiment, the inner and outer layers of the lid are adhesively joined in such a fashion that the outer impermeable layer and the adhesive are peelable from the inner permeable layer in such a fashion that, upon peeling, an integral package comprising the tray having the inner permeable layer of the lid heat sealed thereto remains intact and allows the meat or other package contents to be exposed to the ambient atmosphere. In a second embodiment the inner and outer layers of the lid are heat sealed around their outer periphery so as to exclude the possibility of exposure of the package contents to the atmosphere but the heat seal joining these layers may be ruptured to remove the impermeable outer lid layer without rupturing either the inner permeable lid layer or the seal between that layer and the tray.

In lieu of a tray, a completely flexible package having a removable section comparable to the above described lid may be employed in forming the novel package of the invention. The semi-rigid tray is preferred since it can be provided with grooves in its bottom portion and such grooves may serve to limit the movement of the product within the package; act as a collection point for fluids drawn from the product during vacuum packaging; and, most importantly, permit more rapid circulation of air when the impermeable layer is removed from the package lid or section.

Further objects, features and advantages of the present invention will become apparent from the consideration of the following detailed descriptions of presently preferred embodiments when taken in conjunction with the accompanying drawings, wherein:

FIG. 1 is a cross-sectional view of a first embodiment of the present invention, including a preformed tray and lid;

FIG. 2 is a cross-sectional view similar to FIG. 1, but with the preformed tray modified to include grooves formed in the bottom portion of the tray, illustrating the removal of the outer gas impermeable layer; and FIG. 3 is a perspective view of a second embodiment of the present invention, partially in section, including a pouch having one side formed of a composite of permeable and impermeable layers with the impermeable layer being peeled from one side of the package.

Figure 1:
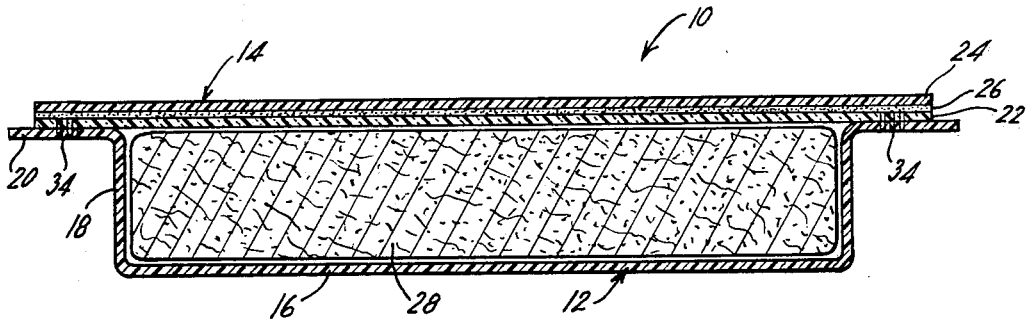

Referring now to FIG. 1, the controlled atmosphere package, which is generally designated by the reference numeral 10, comprises a preformed tray 12 and a composite lid 14. Although the tray as shown is rectangular in shape, a variety of shapes may be employed. Tray 12 includes a flat bottom 16 and sides 18 which terminate in horizontal peripheral flanges 20 to provide seating shoulders for composite lid 14.

Tray 12 is formed by well known techniques, e.g., vacuum thermoforming from a material which is gas impermeable and may be composed of a single polymeric sheet such as polyvinylchloride, nylon, fluorohalocarbon, polyurethane or a composite of polymeric materials including PVC/polyolefin, PVC/saran, PVC/saran/polyolefin, PVC/saran/ethylenevinylacetate copolymer, polystyrene/saran/polyolefin, polystyrene/saran/copolymer, nylon/saran/polyolefin, polyolefin/ saran/polyethlene, polyester/saran/-polyolefin, polycarbonate/saran/ polyolefin or many other such materials which are well known in the art. The essential requirements of tray 12 are that it be formed of materials or composites which possess good oxygen barriers, have adequate thermal formability, are easily sealable to composite lid 14, and have generally good physical strength characteristics. A wide latitude of thicknesses may be employed limited only by economical or practical requirements.

Referring to composite lid 14, it is of substantially the same shape and outer dimensions as horizontal peripheral flanges 20, and is a joint composite comprising an inner layer 22 laminated to an outer layer 24 by a layer of adhesive 26. A perishable product 28 which is to be preserved is placed within the tray 12 and the composite lid 14 is heat sealed in a conventional fashion around the outer periphery of the composite package thereby joining inner layer 22 of composite lid 14 to flanges 20 of tray 12. The package 10 may be evacuated or filled with an inert gas before sealing thereby eliminating oxgen within the package and reducing bacterial and mold growth so that the shelf-life of the product 28 may be extended for prolonged periods of time.

The physical characteristics of inner layer 22, outer layer 24 and adhesive layer 26 in the embodiment of FIG. 1 must be carefully controlled in order for the package construction 10 to function as a controlled atmosphere package. Specifically, composite lid 14 must have a high degree of integrity to withstand abusive handling during packing, shipping and warehousing, such that neither the seals between the tray and lid nor the lamination of the inner and outer layers of the lid are adversely affected by such handling. On the other hand, the inner and outer layers of the lid as well as the adhesive which joins these layers must be constructed in such a fashion that the outer layer 22 and the adhesive layer 26 are readily peelable from inner layer 22 without rupturing that layer or adversely affecting its permeability characteristics or destruction of the heat seal 34 joining the tray 12 to the lid 14.

In order to accomplish the above result, it is essential that inner layer 22 be constructed from a highly gas permeable material and, in addition, that such material be readily heat-sealable to the flanges 20 of tray 12. Materials capable of performing these functions include polyvinylchlorides, polycarbonates, cellophane, polypropylene, polyethylene, polyethylene copolymers, ionomer film or any other gas permeable material having a suitable gas transmission rate of types which are well known in the art. In addition, the inner permeable layer may be constructed of microporous films of any nature in which the holes have been induced chemically or mechanically, such films being particularly useful where a high degree of breathability is required. The thickness of inner layer 22 must be carefully controlled since it must be thin enough to readily transmit gases yet be thick enough to exhibit a cohesive strength in excess of the adhesive strength joining inner layer 22 to outer layer 24 so that rupture is avoided when the outer layer is peeled away from the inner layer. It has been found that thicknesses less than 2.0 mils, preferably 1.5 mils are preferred for this purpose.

Outer gas barrier layer 24 must be selected from gas impermeable materials such as polyester, nylon, cellophane, polypropylene, polyvinyl acetate, saran or combinations of the aforementioned materials with each other or in further combination with polyethylene, ethylene vinyl acetate copolymer, ionomer, or coextrusions involving two or more of the aforementioned polymeric materials. The outer permeable layer 24 may also be formed from materials and combinations of materials similar to those employed to form the tray 12. As with the inner layer 22, the outer layer 24 must be of sufficient oonstruction such that its cohesive strength is in excess of the adhesive strength of adhesive layer 26 in order to avoid rupture of this layer during its removal from the package.

The nature and construction of adhesive layer 26 is also an important feature of the invention. The adhesive layer must have an adhesive strength which is lower than the cohesive strength of either the inner layer 22 or the outer layer 24. Moreover, the adhesive layer must exhibit preferential adhesion to outer layer 24 so that the adhesive layer is simultaneously removed from the package with the removal of the outer layer 24 leaving little or no residue on the inner gas permeable layer 22 upon peeling therefrom so that the gas permeable layer is fully exposed to the surrounding atmosphere after peeling. The adhesive layer is preferably selected from natural or synethic rubber-based adhesives applied from conventional organic solvent solutions although a variety of adhesives may be employed. Ordinarily, the adhesive layer will be tackified with appropriate resins and may be plasticized with compatible plasticizers as is well known in the art. Among the adhesives which may be adapted for use in the package of the invention, are vinylbased thermoplastic adhesives, pressure-sensitive adhesives prepared from natural or synthetic rubbers in conjunction with tackifiers and plasticizers, polyurethanes, heat seal coatings derived from vinyl acetatic copolymers of polyethylene modified with microcrystalline waxes and resins, polyethylene imine primers, and various butyl rubber-resin blends. Such adhesives are well known in the art and are commercially available.

The adhesive strength of the adhesive layer and its preferential adhesive to the outer layer 24 may be controlled by suitable modification of either the adhesive layer itself, the inner layer 22 or possibly both. Incorporation of adulterants or incompatible additives such as ethylene glycol, polyethylene glycol, polyvinyl strearate, polyvinyl octadecyl ether, and other suitable adhesion depressants which are well known in the art into adhesive layer 26 will reduce the adhesive strength of that layer to the desired level. Alternatively, the inner layer 22 may be chosen from materials having reduced adhesion properties, e.g., untreated polyethylene. As a further alternative, conventional slip agents such as the Werner chrom complex of fatty acid or a maleic anhydride-octadecyl vinyl ether copolymer may be incorporated in the inner layer 22 during its formation. These agents may eventually bloom to the surface of the inner layer, and do in effect diminish the adhesive strength of the adhesion between adhesive layer 26 and the inner layer 22.

By careful control of the adhesive and cohesive strengths of the various layers forming composite lid 14, the outer gas impermeable layer 24 may be readily removed from inner gas permeable layer 22 along with adhesive layer 26 by simply taking hold of a corner of outer layer 24 and pulling it in an upward and backward motion so as to peel the entire outer layer 24 and the adhesive layer 26 away from inner layer 22. This peeling procedure may be accomplished by any unskilled person almost instantaneously. To further enhance peelability, a tab or flat corner (such as tab 56 in FIG. 3) may be incorporated on one edge of outer layer 24 to provide a starting point for the peeling procudure. It has been found that by maintaining the heat seal 34 between tray 12 and inner layer 22 of lid 14 in excess of 5 lbs. per inch and the tensile strength of outer layer 24 in excess of 5 lbs. per inch, the weak bond between inner layer 22 and outer layer 24 can be made to fail by maintaining it at a level of between 0.2 lbs. per inch and less than 5.0 lbs. per inch, preferably between 0.25 lbs. per inch and 1 lb. per inch. By maintaining this balance of adhesive and cohesive strengths, removal of outer layer 24 from inner layer 22 can be readily accomplished without rupture of either layer.

Figure 2:
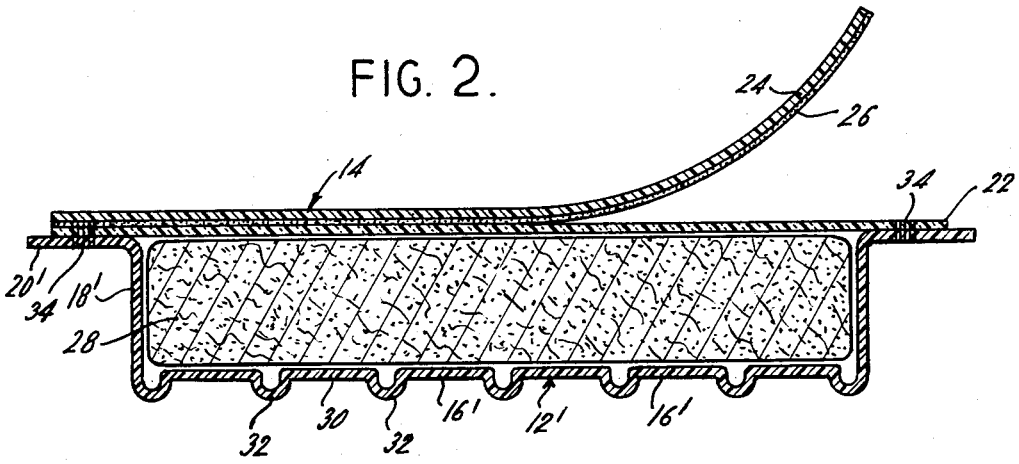

A modified form of the first embodiment of the present invention is shown in FIG. 2. The package 10' of FIG. 2 is similar in all respects to the package 10 shown in FIG. 1, except that tray 12' of FIG. 2 is provided with a series of well-defined ridges 30 and a network of grooves 32 formed in bottom portion 16'. Such an arrangement is a particularly preferred embodiment of the invention when an inert atmosphere is employed for packaging instead of evacuating package 10'. An inert atmosphere is generally preferred since the forces impinging upon the meat product 28 due to the pressure differential between the inside of the package 10' and the atmospheric condition outside the package when vacuum packaging is employed, causes purging i.e. an exudation of blood-like fluids. However, inert gas packages normally result in a loose fit of the product within the package which will generate motion of the product within the package and thus destroy its aesthetic appeal. The package 10', as shown in FIG. 2, provided with ridges 30 retards movement of product 28 within the package.

It is a further feature of the invention to reduce the loose fit normally associated with inert atmosphere packaging by employing an inert gas mixture of nitrogen and carbon dioxide. The carbon dioxide is slowly absorbed into the meat product 28, thus creating a partial vacuum which draws the package lid tightly against the meat product without creating the differential pressures and purging normally associated with high vacuum. The amount of carbon dioxide employed may be in the range of 25% to 75% vol. of the mixture, the remainder consisting of nitrogen.

The ridges 30 and grooves 32 provide additional advantages in the package of the invention in that the grooves 32 act as a collection point for any fluid emitted from the product. More importantly, the ridges and grooves serve to greatly enhance air circulation within the package once the outer impermeable layer 24 and adhesive layer 26 are peeled away from inner permeable layer 22. The circulation of air within the package subsequent to peeling is an important aspect of the package structure since thorough circulation is required to insure that the chemical reaction required to bloom the meat from its purple color to the bright red fresh meat color takes place rapidly and completely.

Although the concepts of the present invention have been heretofore explained and illustrated with respect to the tray embodiments shown in FIGS. 1 and 2, the concepts of the present invention have application to other types of packages. More particularly, an all-flexible package or pouch is equally functional and within the scope of the present invention. As may be seen in FIG. 3, an all-flexible package 40 is illustrated employing the easy-peel feature of the present invention. The all-flexible package or pouch 40 includes a front side or wall 42 which may be formed in the same manner and from the same materials as composite lid 14 of the previously described tray embodiments. Specifically, front wall 42 includes an inner gas permeable layer 46 laminated to an outer gas impermeable layer 48 by a layer of adhesive 50. Front wall 42 is heat sealed at its periphery 54 to a back side or wall 44 formed of a gas impermeable material similar to that of the preformed trays 12, 12' with the exception that the gauge of the material is controlled to provide flexibility. Flexible package 40 functions in the same manner as preformed package 10 so that upon peeling of the outer gas impermeable layer 48 and the adhesive layer 50 from the inner gas permeable layer 46, atmospheric gases will enter the package 40 and cause the perishable product 52 therein, such as raw meat, to bloom in the manner previously described. A tab may be provided on outer layer 48 to assist in the commencement of the peeling step.

It should be understood that front wall 42 and back wall 44 of flexible package 40 may be formed from any of the suggested materials previously described with respect to the preformed package 10 of the first embodiment. In addition, it should be clear that flexible package 40 may also be filled under vacuum or in an inert atmosphere as previously described.

Figure 3:
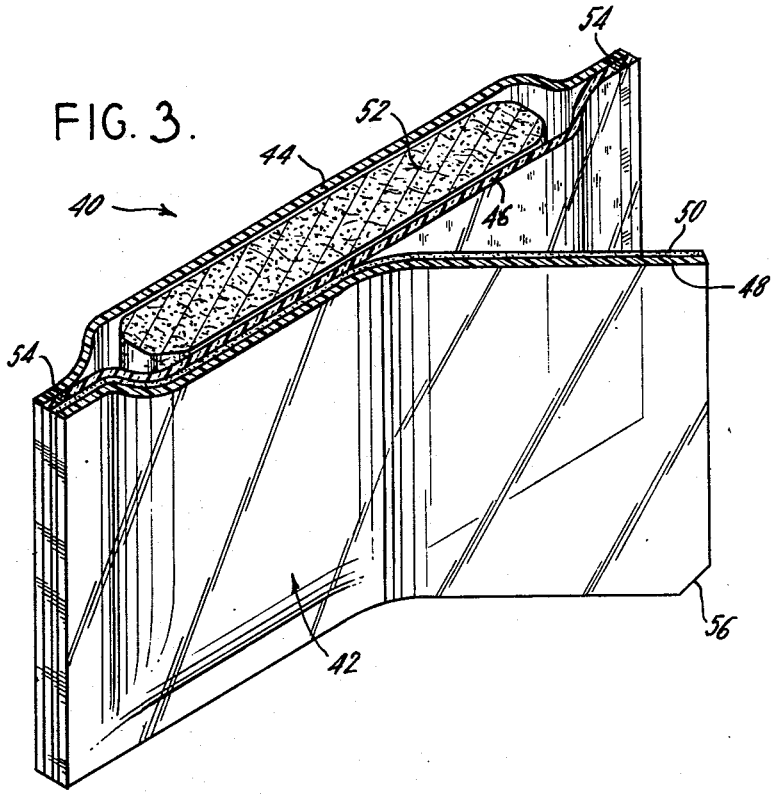
Figure 4:
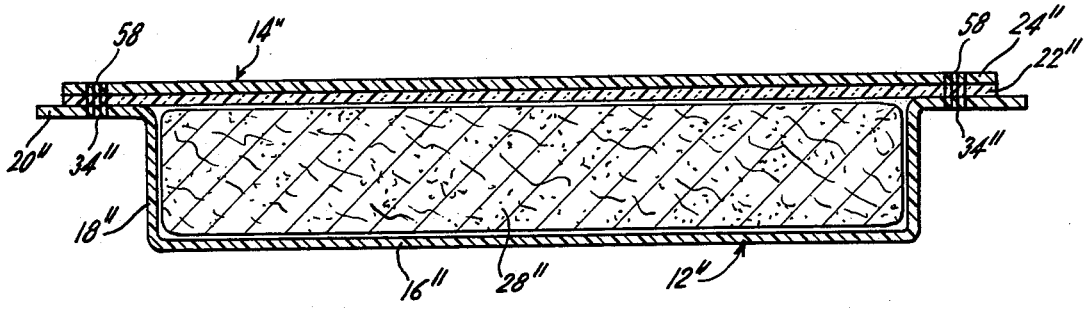
FIG. 4 is a cross-sectional view of an embodiment similar to that shown in FIG. 1 but employing a heat sealed composite lid in lieu of an adhesively joined lid.
Figure 5:
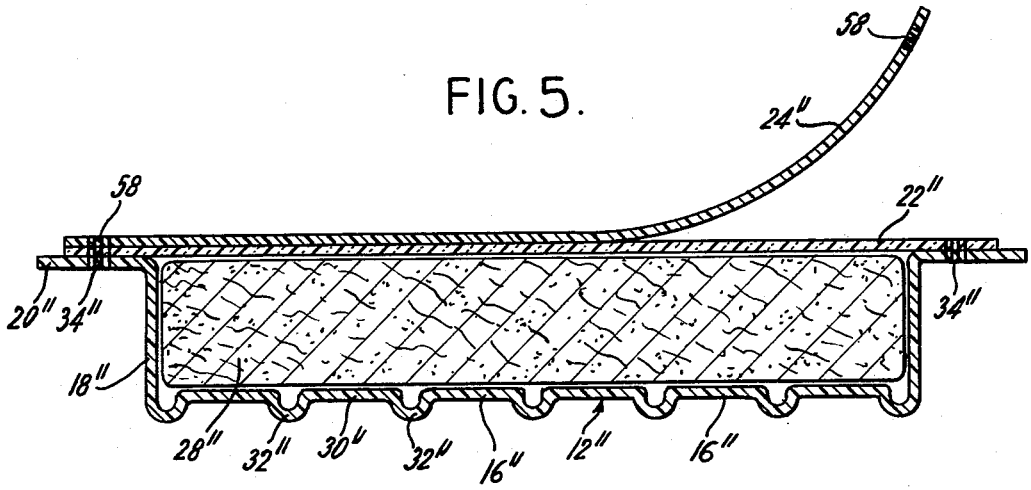
FIG. 5 is a cross-sectional view of the embodiment shown in FIG. 4 with the outer layer of the lid partially removed.

FIGS. 4 and 5 illustrate an embodiment of the invention which is similar to that shown in FIGS. 1 and 2 and which may also be employed in the embodiment shown in FIG. 3. In this embodiment, the lid 14" still comprises an inner layer 22" and an outer layer 24" all previously described. However, in lieu of an adhesive layer 26, the inner and outer layers are joined by a peripheral heat seal 58. The configuration of the package is otherwise generally the same as that described in the earlier embodiments and includes a tray 12" including a bottom 16", side walls 18" and peripheral flanges 20" which together define a compartment for product 28" and inner layer 22" of lid 14" is joined with the tray by a heat seal 34". On a preferred embodiment the tray may include alternate ridges 30" and grooves 32". The heat seal 58 may be formed simultaneously with heat seal 34" or in a separate operation and at a separate location provided only that it is sufficient to prohibit exposure of the package contents to the atmosphere until desired.

As best seen in FIG. 5, the lid 14" is constructed in such a fashion that heat seal 58 will rupture when a peeling force is applied thereby permitting the separation of outer layer 24" from inner permeable layer 22" without rupturing either heat seal 34" between layer 22" and the tray or layer 22" itself. Thus, the package of this embodiment will function in a manner similar to that described in connection with the other embodiment of the invention using heat seals in lieu of an adhesive.

The materials which are employed to form the lid and tray in the embodiment of FIGS. 4 and 5 are generally the same as described in connection with the other embodiments although different combinations of materials and thicknesses of materials may be preferred in order to achieve a rupturable heat seal 58 which will not rupture heat seal 34" or inner layer 22". In general, the heat seal 58 should be constructed to fail at levels comparable to the adhesive layer 26 of the previously described embodiment, i.e. 0.2 lbs. per inch and 5.0 lbs. per inch, preferably between 0.25 lbs. per inch and 1 lb. per inch while the heat seal 34" and the tensile strenths of the inner and outer layers are maintained in excess of 5 lbs. per inch. Control of the rupture of heat seal 58 may be obtained by controlling the gauge of the inner and outer layers and by selecting materials for the outer layer whose heat sealability is inferior to the heat sealability of the inner layer 22" to the tray 12".

Although the present invention has been described with respect to the packaging of refrigerated meat to exclude oxygen, it should be clear that is is equally applicable to a wide variety of products including meats, fruits and vegetables in fresh or frozen form. The product can be pre-frozen prior to packaging or the freezing operation can take place after the package is completed. A frozen product thus packaged can be thawed in the package and the handled in the same manner as fresh meat. Thus, the thawed meat, upon removal of the outer gas impermeable layer, will bloom brightly. In fact, the present invention may be employed in any packaging application where a package is required to exclude undesirable atmospheric factors for prolonged periods of time and then return ambient atmospheric factors at the will of the user. For example, by insertion of suitable foils or other materials in the lid composite, the package of the invention may be employed as a light barrier in lieu of, or in addition to its gas barrier properties. Similarly, the package can be employed to control moisture content, carbon dioxide content or any other factors which may be present in the environment where the packages are employed.

The following examples illustrate the formation of a material suitable for use as a preformed tray in accordance with the invention.

EXAMPLE 1

A polyvinylchloride film of 0.010 inch thickness is coated with approximately one pound per thousand square feet of material with a vinyl base thermoplastic adhesive. The adhesivecoated PVC film is passed through an oven and the dried adhesive is brought into contact with a treated surface of a 0.002 inch thick low density polyethylene film.

EXAMPLE 2

A 0.018 inch thick high impact polystyrene sheet was saran coated and subsequently laminated to a 0.003 inch polyethylene copolymer film as described in Example 1.

EXAMPLE 3

A 0.010 inches thick nylon film was laminated to 0.002 inch of PVDC coated low density polyethylene film using the method employed in Example 1, except that a polyurethane adhesive was employed.

EXAMPLE 4

A low density polyethylene film in a gauge of 0.002 inch was PVDC coated. This PVDC coating operation was performed on a two-station coater. At the first station from approximately 15 to 75 grams per 1,000 square feet of material of a polyurethane prime was applied. After prime coating was dried by passing through a heated drier, a PVDC latex coating was applied thereto by a gravure roll coater. The dry weight of PVDC applied was not less than 0.5 nor more than 3 pounds per thousand square feet. The wet PVDC coating was metered and smoothed by rotating meyer rods. The water was evaported in a drying tunnel and the coated film wound into jumbo rolls. The PVDC coated polyethylene film was transferred to an extrusion coater and from 0.001 inch to about 0.010 inch of nylon resin was coated onto the PVDC coated side of the polyethylene film.

EXAMPLE 5

Cast polypropylene film in gauges of from 0.005 inch and up was saran coated and thereafter coated on an extruder with ethylenevinylacetate copolymer. The polymer coating was preferably 0.002 inch thick, but could vary in gauge from 0.0005 inch to .006 inch and up.

The following examples are illustrative of the formation of the barrier/permeable composite of the invention.

EXAMPLE 6

A saran coated polyester film, 0.0006 inch was laminated to 0.002 inch of low density polyethylene film with the aid of a polyurethane adhesive. To this composite was applied one pound per thousand square feet of an adhesive consisting of a butyl rubber-resin blend in a hexane-methyl ethyl ketone solvent blend and after drying same there was laminated thereto 0.0006 inch of a PVC film.

EXAMPLE 7

A polyester film 0.00075 inch thick was coated with a polyurethane prime and thereafter extrusion coated with 0.002 inch of a ethylene-vinylacetate copolymer. To this composite was applied a butyl rubber adhesive modified with resins and plasticizers in the quantity of from 0.5 to 1.5 pounds per thousand square feet. To the dried adhesive was laminated a 0.001 inch film of surlyn.

EXAMPLE 8

A barrier coated cellophane film was laminated to 0.003 inch of low density polyethylene film with the aid of a polyurethane adhesive. This composite was further laminated to 0.001 inch of a low density polyethylene film with the aid of the butyl rubber adhesive of Example 7.

EXAMPLE 9

A 0.001 inch saran coated nylon film was laminated with the aid of a polyurethane adhesive to 0.002 inch of ionomer film. A butyl rubber resin blend adhesive containing about 2% of a chrom complex of stearates as an adulterant was applied to this composite on the ionomer surface and to the dry adhesive surface was laminated with pressure and heat a 0.0007 inch film of low density polyethylene.

EXAMPLE 10

A 0.002 inch polycarbonate film was primed with a polyurethane adhesive and subsequently was extrusion coated with 0.0005 inch of polyethylene resin. Onto the polycarbonate side of the aforesaid composite was applied from 0.5 to 2.0 pounds of the adulterated butyl rubber adhesive of Example 9 per thousand square feet of material. To the dried athesively coated surface was laminated with pressure and heat 0.002 inch saran coated nylon film. The saran coating on the nylon film faces the butyl rubber adhesive between the nylon and polycarbonate films.

EXAMPLE 11

A foil composite to be employed as a lidding material where a higher degree of barrier is desired, and especially where protection from ultraviolet radiation is required, was prepared by mounting 0.00035 inch foil with the aid of extruded polyethylene onto cellophane. Onto the foil side of this composite was extruded 7½ pounds of polyethylene. Thereafter, on the exposed polyethylene surface was applied from 0.5 to 2.0 pounds of the buyl rubber adhesive of Example 9 per thousand square feet of material. To the dried adhesively coated surface was laminated with heat and pressure 0.001 inch of a low density polyethylene film.

The following examples illustrate the formation and use of the package of the invention.

EXAMPLE 12

A 0.0015 inch permeable iolon film is heat sealed around its outer periphery to a composite material comprising 50 gauge PVDC coated polyester film and 0.001 inch ethylene vinylacetate (EVA) copolymer film to form a lid. When this lid is heat sealed to a tray and a peeling force is applied to the lid, the seal between the EVA and iolon films will rupture leaving the iolon film intact and hermetically sealed to the tray.

EXAMPLE 13

On a form-fill-seal machine, such as Flex-Vac 6–14, was placed a roll of a composite material consisting of polyvinylchloride and polyethylene as prepared in accordance with Example 1.

The machine was equipped with appropriate dies to generate, with the aid of vacuum thermo forming, trays as shown in FIGS. 1 and 2. These trays, while retained in the forming die, were filled with fresh meat cuts. The meat containing trays were moved to the sealing station where the multi-layer composite of Example 8 was placed over their open face. The lidding material was heat sealed to the formed tray, affecting a polyethylene to polyethylene seal over most of the circumference of the package, but leaving sufficient unsealed area to affect adequate evacuation. Following the evacuation step, a 50—50 mixture of nitrogen-carbon dioxide was injected and the final seal completed. Several packages were placed in a corrugated carton and shipped, while maintained at a temperature of from 34° to 40° F, to a retail establishment. At the store, a clerk peeled the barrier layer off the lid material of the refrigerated package and placed the package in a refrigerated display case. The meat was, at that point, several weeks old and had a dark color due to the absence of oxygen within the sealed package. Once the barrier material, in this case saran coated cellophane, was removed the meat turned a bright red within a matter of minutes.

EXAMPLE 14

Pouches such as those illustrated in FIG. 3 were made on a Simplex machine from roll stock. Two web composites were utilized. One web forming the back of the pouch consisted of nylon-polyethylene as prepared in Example 4 and the other composite forming the front of the pouch, was chosen from the barrier-permeable membrane composites as described in Examples 8, 9 or 10.

EXAMPLE 15

A surgical instrument was placed into a preformed tray made from a nylon composite as specified in Example 3. Together with the surgical instrument there was placed into the tray a few drops of an aqueous solution of ethylene oxide. The tray was evacuated, the air replaced with nitrogen, while it was sealed with lidding materials such as specified in examples 8, 9 or 10. Because of the presence of ethylene oxide, the surgical instrument remains sterile as long as the package is in a sealed condition. Shortly prior to use the barrier material is peeled off the lidding stock and the ethylene oxide slowly dissipates from the package. If more rapid loss of ethylene oxide is desired, the package may be slightly heated or placed into a vacuum chamber which will withdraw all residual ethylene oxide from the package. Thereafter the package will retain its sterilized condition for a considerable length of time since it is still in a hermetically sealed condition.

It is to be understood that the examples cited herein are intended for illustrative purposes only to show some of the various ways in which the present invention may be put into practice. These particular examples are not intended to limit the application of the present invention which may be employed with a wide variety of laminate combinations and to package a wide variety of products.

A latitude of modification, change and substituion is intended in the foregoing disclosure and in some instances, some features of the invention will be employed without a corresponding use of other features. Accordingly, it is appropriate that the appended claims be construed broadly and in a manner consistent with the spirit and scope of the invention herein.

What is claimed is:

1. A package for controlling the atmospheric condition of a package product comprising a meat product, a semi-rigid performed tray for holding said meat product, said tray being formed from a material which is oxygen impermeable and a composite lid, said composite lid being heat-sealed to said preformed tray around the periphery thereof to define a sealed package containing said meat product, a substantially non-oxygen containing atmosphere surrounding said meat product, said composite lid comprising an inner layer, an intermediate adhesive layer and an outer layer, said inner layer being formed from an oxygen impermeable material, said outer layer being formed from an oxygen impermeable material, said outer layer being secured to said inner layer by said adhesive layer to provide a hermetically sealed oxygen impermeable package, said outer layer and said adhesive layer being removable from said inner layer without destruction of said seal between said tray and said lid so as to allow oxygen to flow through said inner layer.

2. A package in accordance with claim 1, wherein said tray includes a plurality of grooves and ridges in the bottom thereof.

3. A package in accordance with claim 1, wherein the atomsphere surrounding said meat product is an inert atmosphere and comprises a mixture of nitrogen and carbon dioxide.

4. A package in accordance with claim 1, wherein the atmosphere surrounding said meat product is a vacuum.

5. A package in accordance with claim 1, wherein said adhesive layer remains adhered to said outer layer upon removal of said outer layer from said inner layer.

6. A package in accordance with claim 5, wherein said outer layer has a tensile strength in excess of about 5.0 pounds per inch and said adhesive layer has an adhesive strength of about 0.2 to about 5.0 pounds per inch.

* * * * *

UNITED STATES PATENT AND TRADEMARK OFFICE

CERTIFICATE OF CORRECTION

PATENT NO. : 4,055,672

DATED : October 25, 1977

INVENTOR(S) : Arthur Hirsch et al.

It is certified that error appears in the above-identified patent and that said Letters Patent are hereby corrected as shown below:

Claim 1, column 12, line 4 "impermeable" should read -- permeable --.

Signed and Sealed this

*First* Day of *August 1978*

[SEAL]

*Attest:*

RUTH C. MASON
*Attesting Officer*

DONALD W. BANNER
*Commissioner of Patents and Trademarks*